US008789652B2

(12) United States Patent
Swallowe et al.

(10) Patent No.: US 8,789,652 B2
(45) Date of Patent: Jul. 29, 2014

(54) ATTENUATORS, ARRANGEMENTS OF ATTENUATORS, ACOUSTIC BARRIERS AND METHODS FOR CONSTRUCTING ACOUSTIC BARRIERS

(75) Inventors: Gerard Michael Swallowe, Leicestershire (GB); Daniel Peter Elford, Leicestershire (GB); Feodor Kusmartsev, Leicestershire (GB); Luke Chalmers, Leicestershire (GB)

(73) Assignee: Sonobex Limited, Warwickshire (GB)

( * ) Notice: Subject to any disclaimer, the term of this patent is extended or adjusted under 35 U.S.C. 154(b) by 222 days.

(21) Appl. No.: 13/148,020

(22) PCT Filed: Feb. 4, 2010

(86) PCT No.: PCT/EP2010/051370

§ 371 (c)(1),
(2), (4) Date: Mar. 1, 2012

(87) PCT Pub. No.: WO2010/089351

PCT Pub. Date: Aug. 12, 2010

(65) Prior Publication Data

US 2012/0152650 A1 Jun. 21, 2012

(30) Foreign Application Priority Data

Feb. 6, 2009 (GB) ..... 0901982.9

(51) Int. Cl.
*E04B 1/84* (2006.01)
*E04B 1/82* (2006.01)

(52) U.S. Cl.
USPC ..... 181/293; 181/295

(58) Field of Classification Search
USPC ..... 181/293, 295, 210, 270, 279, 30
See application file for complete search history.

(56) References Cited

U.S. PATENT DOCUMENTS

| | | | | |
|---|---|---|---|---|
| 2,007,130 | A * | 7/1935 | Munroe et al. | 181/285 |
| 2,610,695 | A * | 9/1952 | Grue | 181/295 |
| 3,124,798 | A | 3/1964 | Zinke | |
| 3,269,484 | A * | 8/1966 | Lighter | 181/290 |
| 3,275,101 | A * | 9/1966 | Davis, Jr. et al. | 181/285 |
| 3,412,513 | A * | 11/1968 | Gosele | 52/144 |
| 3,672,463 | A | 6/1972 | Jaffe et al. | |
| 3,783,968 | A | 1/1974 | Derry | |
| 3,812,931 | A | 5/1974 | Hauskins, Jr. | |
| 3,936,035 | A | 2/1976 | Weimar et al. | |

(Continued)

FOREIGN PATENT DOCUMENTS

| | | |
|---|---|---|
| CA | 2067480 | 10/1992 |
| DE | 2834683 B1 | 10/1979 |

(Continued)

OTHER PUBLICATIONS

International Search Report from corresponding International Application No. PCT/EP2010/051370, Jun. 2010.

(Continued)

*Primary Examiner* — Edgardo San Martin
(74) *Attorney, Agent, or Firm* — Lee & Hayes, PLLC

(57) ABSTRACT

An attenuator for attenuating acoustic waves, the attenuator comprising: a first body defining a cavity therein and an elongate open aperture extending across a substantial portion of the first body, the first body being configured to attenuate acoustic waves over a resonant frequency band.

19 Claims, 8 Drawing Sheets

(56) References Cited

U.S. PATENT DOCUMENTS

| | | | | | |
|---|---|---|---|---|---|
| 4,083,395 | A | | 4/1978 | Romano | |
| 4,095,669 | A | | 6/1978 | Bond, Sr. | |
| 4,319,661 | A | * | 3/1982 | Proudfoot | 181/295 |
| 4,821,841 | A | * | 4/1989 | Woodward et al. | 181/286 |
| 5,137,111 | A | * | 8/1992 | Diduck et al. | 181/295 |
| 5,210,383 | A | * | 5/1993 | Noxon | 181/290 |
| 5,220,535 | A | | 6/1993 | Brigham et al. | |
| 5,444,198 | A | * | 8/1995 | Gallas | 181/295 |
| 5,457,291 | A | | 10/1995 | Richardson | |
| 5,504,281 | A | | 4/1996 | Whitney et al. | |
| 5,905,234 | A | * | 5/1999 | Tsukamoto et al. | 181/286 |
| 5,960,236 | A | | 9/1999 | Zaman et al. | |
| 5,972,450 | A | | 10/1999 | Hsich et al. | |
| 6,021,612 | A | * | 2/2000 | Dunn et al. | 52/144 |
| 6,568,135 | B1 | | 5/2003 | Yokoyama | |
| 2003/0006090 | A1 | | 1/2003 | Reed | |
| 2003/0089734 | A1 | * | 5/2003 | Eberhardt et al. | 222/39 |
| 2005/0258000 | A1 | * | 11/2005 | Yano et al. | 181/210 |
| 2006/0169531 | A1 | | 8/2006 | Volker | |

FOREIGN PATENT DOCUMENTS

| | | | | | |
|---|---|---|---|---|---|
| EP | 0193408 | | | 9/1986 | |
| EP | 0447797 | A2 | | 9/1991 | |
| FR | 2630469 | A1 | * | 10/1989 | E01F 8/00 |
| GB | 2027255 | | | 2/1980 | |
| JP | 04281905 | A | | 10/1992 | |
| JP | 2002220817 | A | | 8/2002 | |
| JP | 2003328326 | A | | 11/2003 | |
| JP | 2009078539 | | | 4/2009 | |
| WO | WO9839767 | | | 6/1997 | |
| WO | WO9721024 | | | 9/1998 | |
| WO | WO9839759 | | | 9/1998 | |
| WO | 2006098694 | A1 | | 9/2006 | |

OTHER PUBLICATIONS

International Search Report dated Jun. 30, 2009 for International Counterpart Application No. GB0901982.9, 6 pages.

* cited by examiner

ATTENUATORS, ARRANGEMENTS OF ATTENUATORS, ACOUSTIC BARRIERS AND METHODS FOR CONSTRUCTING ACOUSTIC BARRIERS

The present application is the U.S. national stage under 35 U.S.C. § 371 of International Application Ser. No. PCT/EP2010/051370, having an International Filing Date of Feb. 4, 2010, and which claims priority of Great Britain application No. 0901982.9 filed on Feb. 6, 2009 the contents of which are incorporated herein by reference.

FIELD OF THE INVENTION

Embodiments of the present invention relate to attenuators, arrangements of attenuators, acoustic barriers and methods for constructing acoustic barriers. In particular, they relate to attenuators, arrangements of attenuators, acoustic barriers and methods for constructing acoustic barriers for attenuating acoustic waves.

BACKGROUND TO THE INVENTION

Acoustic waves may be produced by a large variety of sources. For example, acoustic waves may be produced by people, motor vehicles, airplanes and electronic equipment. For many people, these acoustic waves may be unpleasant and therefore considered noise.

One way to reduce noise is to provide a solid wall (consisting of a masonry wall or earthwork for example) between the person and the source of the noise. However, such solid walls may be relatively expensive to construct, require maintenance and have poor drainage for surface water.

Therefore, it would be desirable to provide an alternative attenuator.

BRIEF DESCRIPTION OF VARIOUS EMBODIMENTS OF THE INVENTION

According to various, but not necessarily all, embodiments of the invention there is provided an attenuator for attenuating acoustic waves, the attenuator comprising: a first body defining a cavity therein and an elongate open aperture extending across a substantial portion of the first body, the first body being configured to attenuate acoustic waves over a resonant frequency band.

The first body may define a single elongate open aperture. The first body may be substantially elongate in shape. The elongate open aperture may extend along the length of the body. The elongate open aperture may extend along a substantial portion of the length of the body. The length of the elongate open aperture may be greater than or substantially equal to ninety percent of the length of the first body.

The resonant frequency band may be substantially independent of the material of the body. The resonant frequency band may be weakly dependent on the material of the body.

The magnitude of attenuation provided by the attenuator may be substantially unaffected by the orientation of the attenuator relative to the source of the acoustic waves.

The attenuator may further comprise a second body positioned within the cavity of the first body. The second body may define a cavity therein and an elongate open aperture extending across a substantial portion of the second body. The second body may be configured to attenuate acoustic waves over a further resonant frequency band, different to the resonant frequency band.

The first body and the second body may not be connected to one another.

The second body may be replaceable with a third body. The third body may define a cavity therein and an elongate open aperture extending across a substantial portion of the third body. The third body may be configured to attenuate acoustic waves over another resonant frequency band, different to the resonant frequency bands of the first body and the second body.

The first body may define a spiral shape in cross section.

The attenuator may further comprise a plurality of walls within the cavity that define a plurality of compartments. The first body may comprise a plurality of open elongate apertures for at least some of the plurality of compartments.

The attenuator may further comprise a plurality of walls within the cavity that define a plurality of compartments. At least some of the plurality of walls may define an open elongate aperture.

According to various, but not necessarily all, embodiments of the invention there is provided an arrangement comprising a plurality of attenuators as described in the preceding paragraphs.

The plurality of attenuators may not be connected to one another.

At least some of the plurality of attenuators may be arranged periodically into a plurality of rows. The distance between the rows of attenuators may be selected so that the rows of attenuators attenuate acoustic waves over a further resonant frequency band.

A first subset of the plurality of attenuators may be configured to attenuate acoustic waves over a first resonant frequency band and a second subset of the plurality of attenuators may be configured to attenuate acoustic waves over a second resonant frequency band, different to the first resonant frequency band.

The plurality of attenuators may include a plurality of subsets of attenuators. Each subset of attenuators may be configured to attenuate acoustic waves over a resonant frequency band, different to the resonant frequency bands of the other subsets of attenuators.

According to various, but not necessarily all, embodiments of the invention, there is provided an acoustic barrier for attenuating acoustic waves, the acoustic barrier comprising an arrangement as described in the preceding paragraphs.

According to various, but not necessarily all, embodiments of the invention, there is provided an acoustic filter for filtering acoustic waves, the acoustic filter comprising an arrangement as described in the preceding paragraphs.

The plurality of attenuators of the arrangement may be spaced apart from one another for enabling the passage of light and/or fresh air therethrough.

According to various, but not necessarily all, embodiments of the present invention, there is provided a method for constructing an acoustic barrier, the method comprising: providing an arrangement of attenuators as described in the preceding paragraphs; and arranging the plurality of attenuators in the arrangement to form an acoustic barrier.

The method may further comprise arranging the plurality of attenuators so that they are spaced apart from one another for enabling the passage of light and/or fresh air therethrough.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

FIGS. 1, 4, 5A, 5B, 6 and 7 illustrate an attenuator 10, 38 for attenuating acoustic waves, the attenuator 10, 38 comprising a first body 12, 40 defining a cavity 14, 42 therein and an elongate open aperture 20, 44 extending across a substantial portion of the first body 12, 40, the first body 12, 40 being configured to attenuate acoustic waves over a resonant frequency band.

Figure 1:
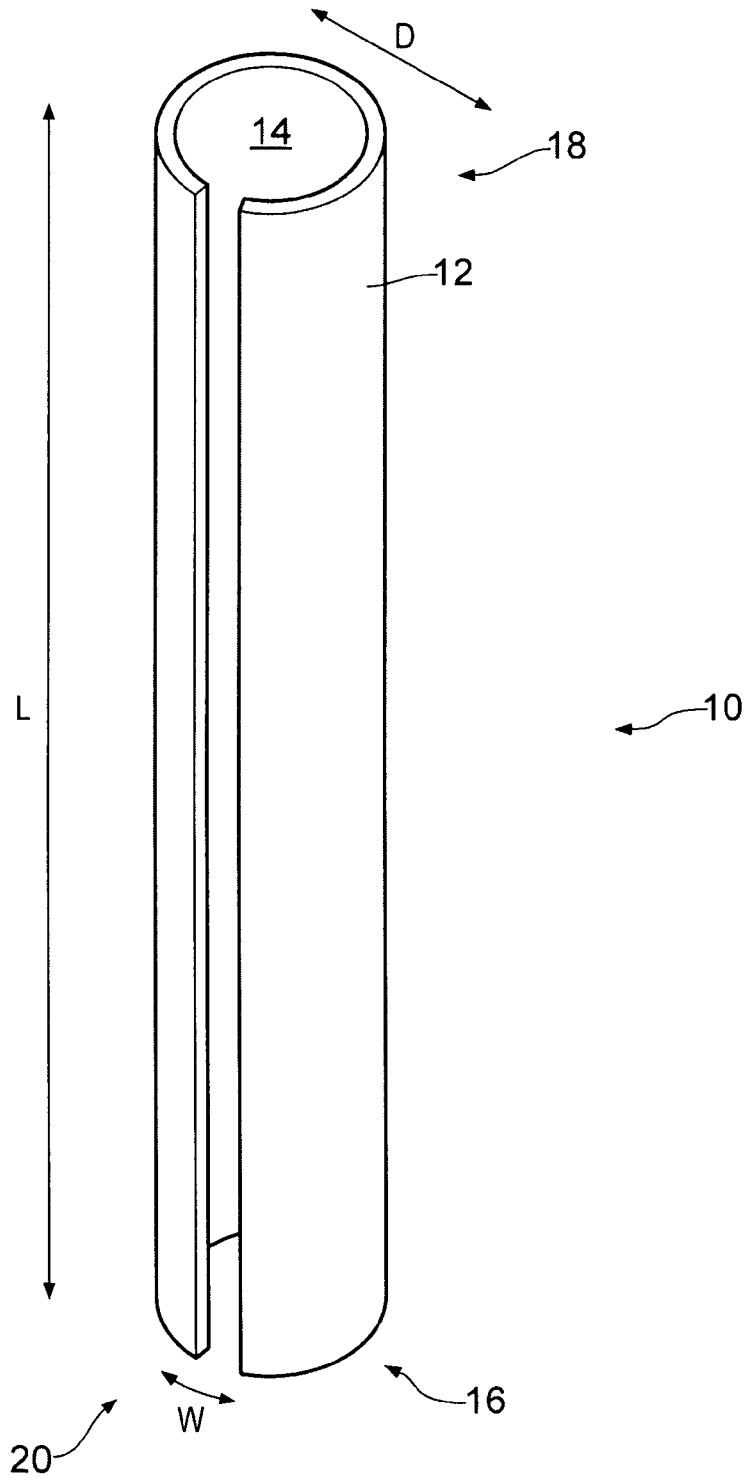
FIG. 1 illustrates a perspective view of an attenuator according to various embodiments of the present invention.

In more detail, FIG. 1 illustrates a perspective view of an attenuator 10 including an elongate body 12 that is tubular in shape. The body 12 may comprise any suitable material and may comprise, for example, aluminum, brass, copper, diamond, gold, iron, lead, Pyrex glass, rubber or steel. The body 12 has a diameter D, a length L, a first end portion 16 and a second end portion 18 opposite to the first end portion 16.

The body 12 defines a cavity 14 therein (i.e. the body 12 is substantially hollow) and an elongate open aperture 20, having a width W, that extends along the entire length of the body 12 from the first end portion 16 to the second end portion 18. In this embodiment, the length of the elongate open aperture 20 is substantially equal to the length L of the body 12. However, in other embodiments the length of the elongate open aperture may be any substantial portion of the length of the body 12 and may be equal to or greater than ninety percent of the length of the body 12.

The elongate open aperture 20 is 'open' since it is not covered by a barrier that prevents the flow of fluid (e.g. air) into or out of the cavity 14. Consequently, fluid is able to enter and leave the cavity 14 via the elongate open aperture 20 without obstruction. In this embodiment, the first and second end portions 16, 18 are also open. In other embodiments, the first and second end portions 16, 18 may be covered by a barrier which prevents the passage of fluid there through.

The body 12 is configured to attenuate incident acoustic waves over a resonant frequency band. In operation, acoustic waves may enter the cavity 14 of the body 12 through the elongate open aperture 20 and through the body 12. The air in the cavity 14 resonates if the frequency of the acoustic waves is within the resonant frequency band of the cavity 14. Since the elongate open aperture 20 extends across a substantial portion of the body 12, a plurality of standing waves form in the cavity 14, each having a different length to one another. Since each standing wave provides a different resonant frequency, the plurality of standing waves together provide the resonant frequency band of the cavity 14.

The above mentioned resonance reduces the energy of the incident acoustic waves since the energy is transferred from the acoustic waves to the air in the cavity 14. Additionally, the attenuator 10 at least partially reflects the acoustic waves back toward their source. Consequently, if an attenuator 10 is positioned between an acoustic wave source and an observer, the attenuator 10 reduces the amplitude (i.e. volume) of the acoustic wave heard by the observer.

In more detail, when a pressure variation (for example, in the form of a sound wave) interacts with the air in the elongate open aperture 20, the pressure of the air in the cavity 14 increases. As the external force is removed, the pressure equalizes and forces air back through the elongate open aperture 20. Due to the inertia of the air in the elongate open aperture 20, a region of low pressure is created in the cavity 14, which in turn causes air to be drawn back into the cavity 14. The air then continues to oscillate and causes attenuation of the incident sound wave.

The attenuation associated with the attenuator 10 is substantially provided by the resonance of the air in the cavity 14 and not by the mechanical resonance of the body 12 itself. Consequently, the desirable resonant frequency band of the body 12 is substantially independent of the material of the body 12. Additionally, it has been observed that the magnitude of attenuation provided by the attenuator 10 is substantially unaffected by the orientation of the attenuator 10 (and hence the orientation of the elongate open aperture 20) relative to the source of acoustic waves.

It should be appreciated that the dimensions of the body 12 and the elongate open aperture 20 determine the resonant frequency band of the attenuator 10. This will now be explained in detail in the following paragraphs with reference to FIGS. 1, 2 and 3.

Figure 2:
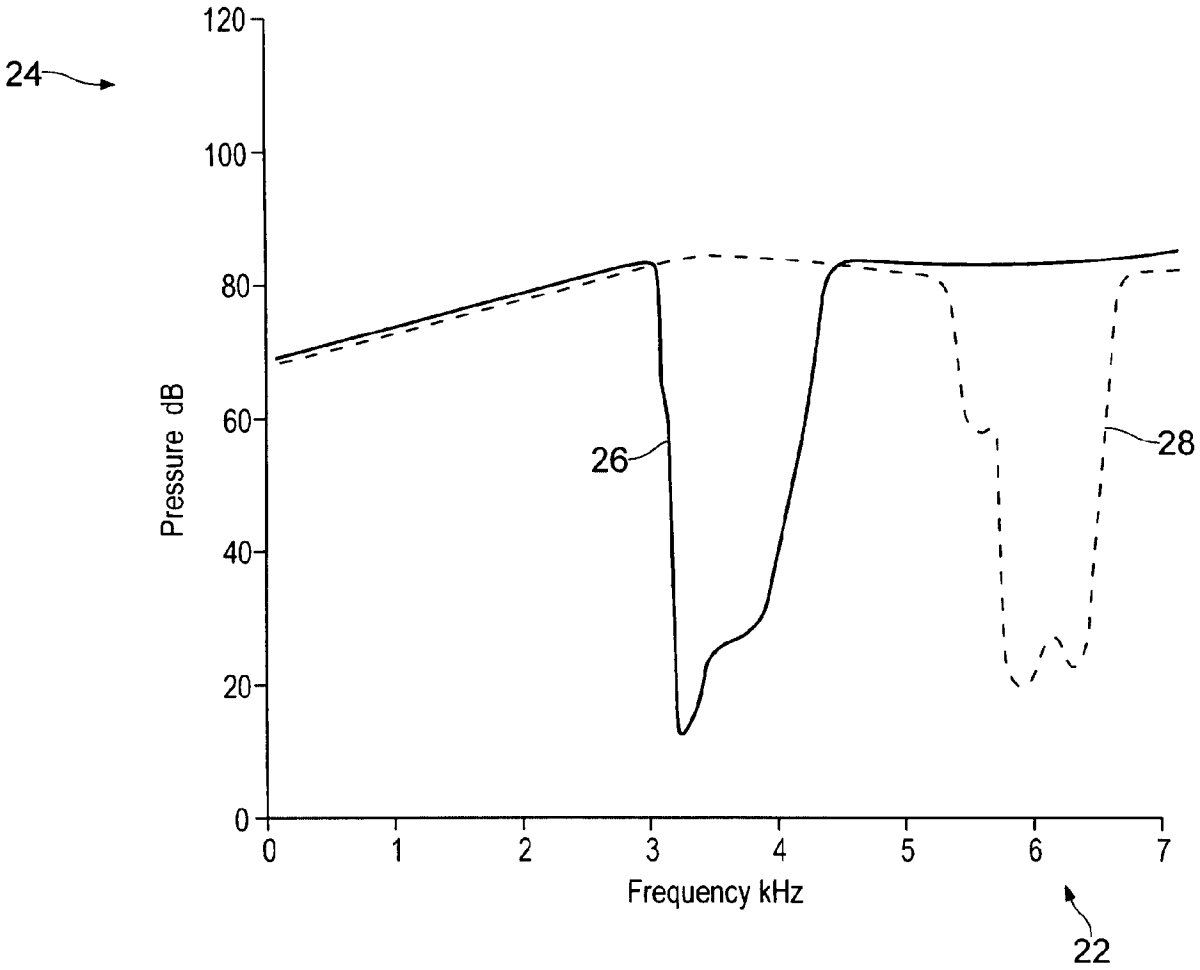
FIG. 2 illustrates a graph of frequency versus pressure for two attenuators having different diameters according to various embodiments of the present invention.

FIG. 2 illustrates a graph of frequency versus pressure for two attenuators 10 having different diameters D (and therefore different volumes). The graph includes an X axis 22 for frequency (in kilohertz), a Y axis 24 for pressure (in dB), a solid line 26 representing an attenuator having a diameter D of 14 mm and a dotted line 28 representing an attenuator having a diameter D of 10 mm.

With reference to the solid line 26, the pressure increases from approximately 70 dB at 0.5 kHz to approximately 80 dB at 3 kHz. In the region of the resonance band gap at 3.0 kHz, the pressure decreases and reaches a minima of 15 dB at approximately 3.5 kHz. After 3.5 kHz, the pressure increases and is approximately 80 dB at 4.5 kHz. After 4.5 kHz, the pressure remains substantially constant at 80 dB.

With reference to the dotted line 28, the pressure increases from approximately 70 dB at 0.5 kHz to approximately 80 dB at 3 kHz and remains constant until 5 kHz. In the region of the resonance band gap at 5 kHz, the pressure decreases and reaches a minima of 15 dB at approximately 6 kHz. After 6 kHz, the pressure increases and is approximately 80 dB at 6.5 kHz. After 6.5 kHz, the pressure remains substantially constant at 80 dB.

From the above paragraphs, it should be appreciated that an increase in the diameter D (and hence volume) of the body 12 of an attenuator 10 lowers the position of the resonant frequency band of the body 12 on the frequency axis 22.

Figure 3:
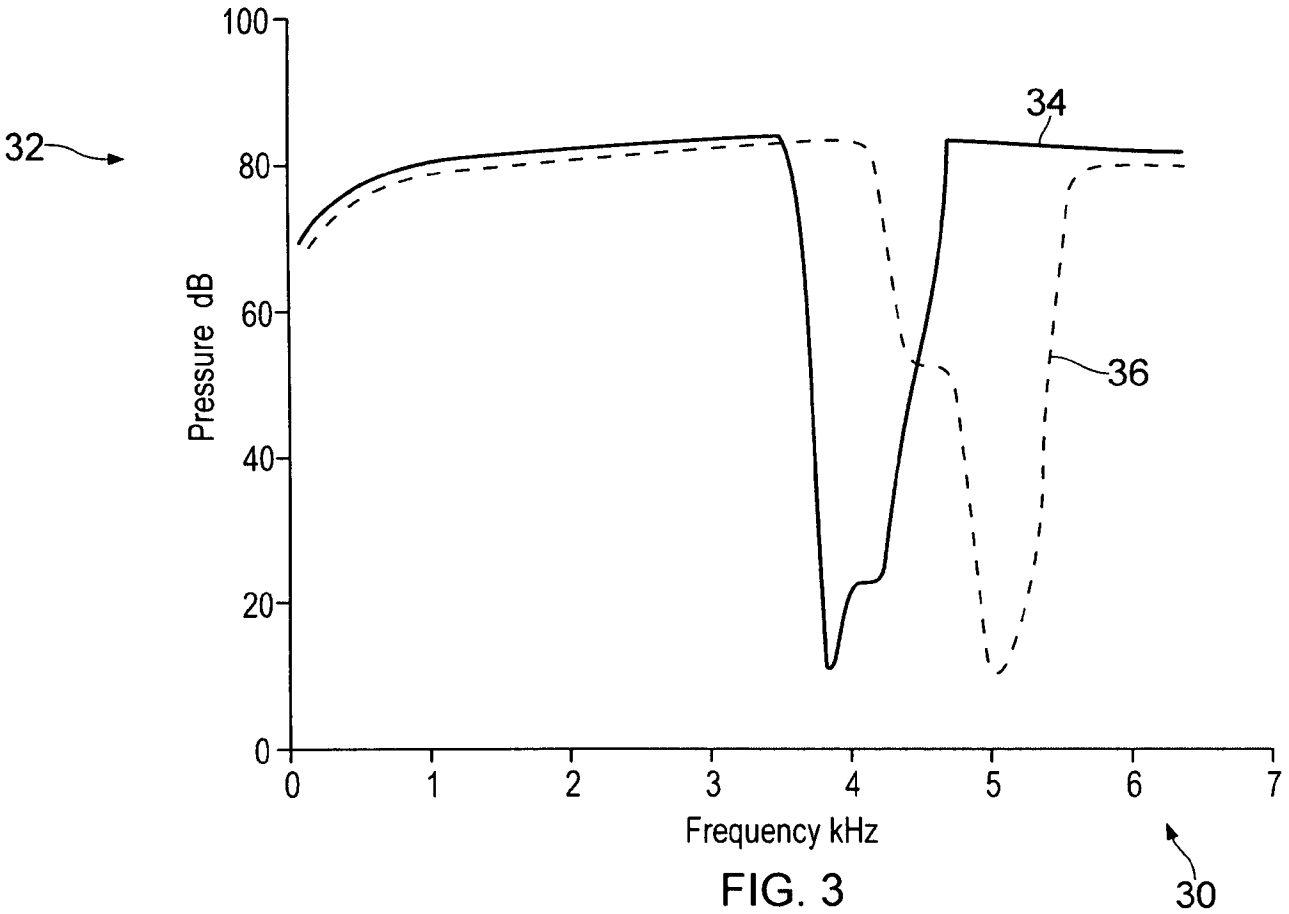
FIG. 3 illustrates a graph of frequency versus pressure for two attenuators having elongate open apertures with different widths according to various embodiments of the present invention.

FIG. 3 illustrates a graph of frequency versus pressure for two attenuators 10 having elongate open apertures 20 with different widths W. The graph includes an X axis 30 for frequency (in kilohertz), a Y axis 32 for pressure (in dB), a solid line 34 representing an attenuator having an elongate open aperture with a width of 2.0 mm and a dotted line 36 representing an attenuator having an elongate open aperture with a width of 5.0 mm.

With reference to the solid line 34, the pressure is substantially constant at 80 dB between the frequencies of 0.5 kHz and 3.5 kHz. In the region of the resonance band gap at 3.5 kHz, the pressure decreases and reaches a minima of 10 dB at approximately 4 kHz. After 4 kHz, the pressure increases and is approximately 80 dB at 4.5 kHz. After 4.5 kHz, the pressure remains substantially constant at 80 dB.

With reference to the dotted line 36, the pressure is substantially constant at 80 dB between the frequencies of 0.5 kHz and 4.0 kHz. In the region of the resonance band gap at 4.0 kHz, the pressure decreases and reaches a minima of 10 dB at approximately 5 kHz. After 5 kHz, the pressure increases and is approximately 80 dB at 5.5 kHz. After 5.5 kHz, the pressure remains substantially constant at 80 dB.

From the above paragraphs, it should be appreciated that an increase in the width W of an elongate open aperture moves the location of the resonant frequency band of the body 12 to higher frequencies.

Embodiments of the present invention provide an advantage in that the body 12 of the attenuator 10 may be configured to attenuate a particular frequency band of interest (for example, to attenuate noise over a particular frequency range). For example, if it is desired to attenuate acoustic waves having a frequency of between 3.0 kHz and 6.0 kHz, the diameter D of the body 12 and the width W of the elongate open aperture 20 may be chosen to obtain optimum attenuation at those frequencies.

Furthermore, another advantage provided by embodiments of the present invention is that the material of the body 12 can be freely selected for any application since the resonant frequency band of the body 12 is substantially independent of the material of the body 12. For example, if it is desired to reduce the visibility of the attenuator 10, the body 12 may comprise Pyrex glass. Alternatively, if it is desired to increase the visibility of the attenuator 10 (e.g. for decorative purposes), the body 12 may comprise diamond or gold.

Figure 4:
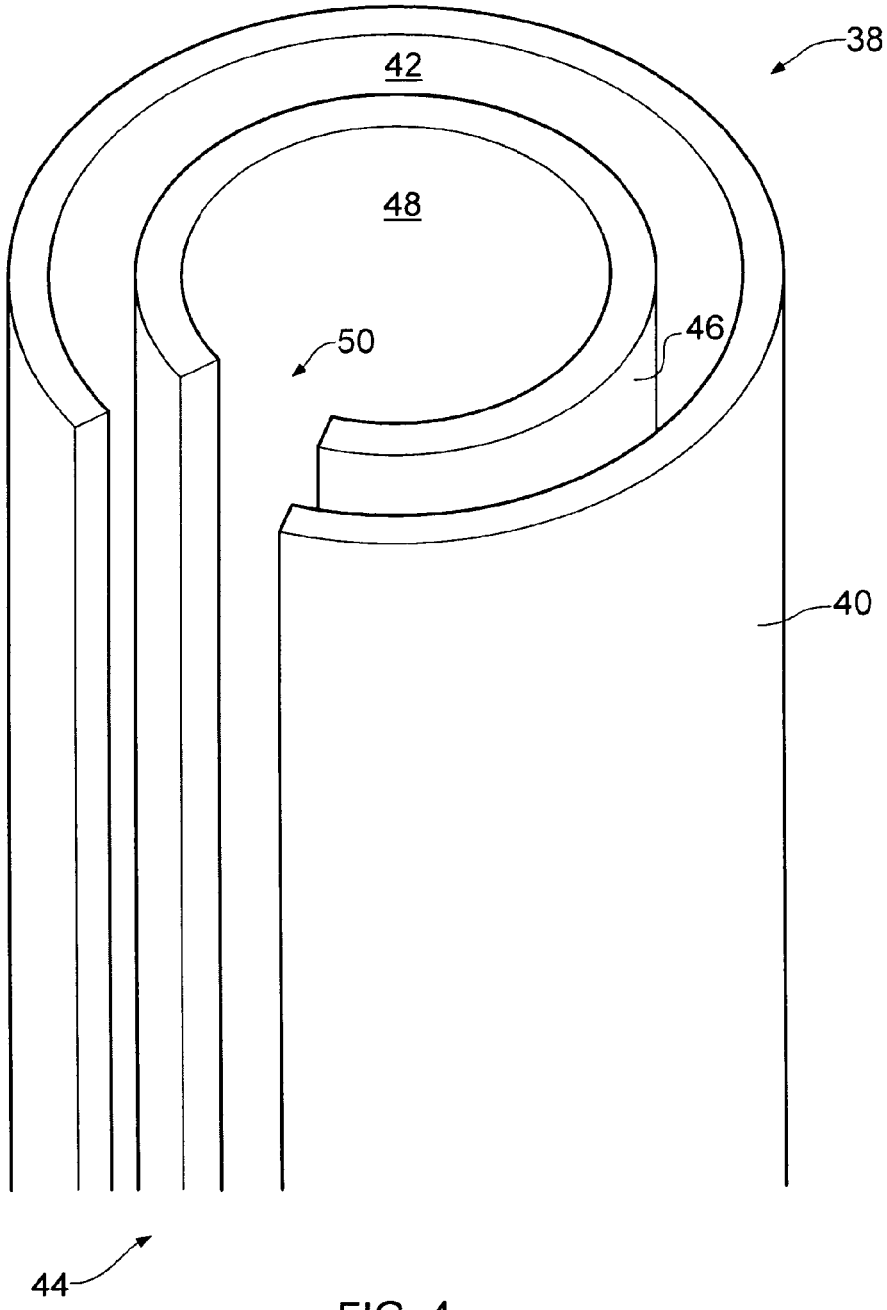
FIG. 4 illustrates a perspective view of another attenuator according to various embodiments of the present invention.

FIG. 4 illustrates a perspective view of another attenuator 38 according to various embodiments of the present invention. The attenuator 38 is similar to the attenuator 10 illustrated in FIG. 1 and is configured to attenuate acoustic waves in a similar manner. The attenuator 38 includes a first body 40 defining a cavity 42 therein and an elongate open aperture 44 that extends across a substantial portion of the body 40. The attenuator 38 also includes a second body 46 that is positioned within the cavity 42 of the first body 40. The second body 46 also defines a cavity 48 therein and an elongate open aperture 50 that extends across a substantial portion of the second body 46. The first body 40 and the second body 46 are configured to attenuate acoustic waves over different resonant frequency bands. For example, the first body may be configured to attenuate acoustic waves in the frequency range of 3 kHz to 4 kHz and the second body may be configured to attenuate acoustic waves in the frequency range of 4 kHz to 5 kHz.

The attenuator 38 illustrated in FIG. 4 may provide an advantage in that it may be able to attenuate acoustic waves over a greater range of frequencies (when compared to the attenuator 10 illustrated in FIG. 1). Furthermore, the attenuator 38 may not require any more space than the attenuator 10 illustrated in FIG. 1 since the second body 46 is positioned within the cavity 42 of the first body 40.

The first body 40 and the second body 46 are not connected to one another (that is, the attenuator 38 includes no connectors between the first body 40 and the second body 46). This may provide an advantage in that the attenuator 38 may be relatively easy to manufacture. Additionally, if a change in the resonant frequency bands of the attenuator 38 is desired, the first body 40 or second body 46 may be replaced with other bodies that have different resonant frequency bands to the first body 40 and the second body 46. For example, the second body 46 may be replaced with another body (not illustrated) that has a different resonant frequency band to the resonant frequency bands of the first body 40 and the second body 46.

It should be appreciated that the attenuator 38 may include a third body (not illustrated for clarity purposes) positioned within the cavity 48 of the second body 46, and a fourth body (not illustrated for clarity purposes) positioned within the cavity of the third body and so on (each body being configured to attenuate acoustic waves over different resonant frequency bands). Alternatively, if the diameter of the first body 40 is relatively large, the cavity 42 may include a plurality of bodies which are not positioned inside one another, each of which being configured to attenuate acoustic waves over different resonant frequency bands. In both of these embodiments, the plurality of bodies may not be connected to one another. These embodiments may provide an advantage in that they may attenuate acoustic waves over a very broad frequency range.

Figure 5A:
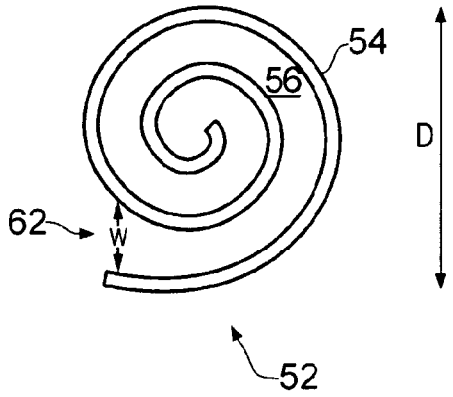
FIG. 5A illustrates a cross sectional plan view of a further attenuator according to various embodiments of the present invention.
Figure 5B:
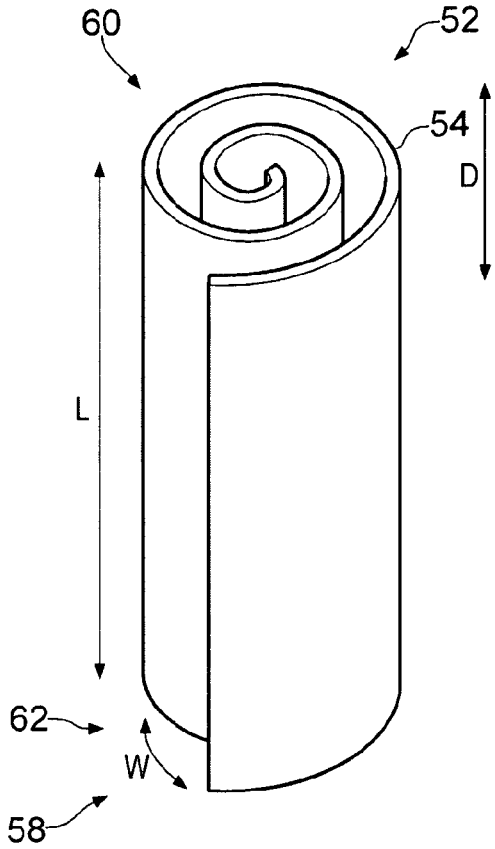
FIG. 5B illustrates a perspective view of the attenuator illustrated in FIG. 5A.

FIG. 5A illustrates a cross sectional plan view of a further attenuator 52 and FIG. 5B illustrates a perspective view of the attenuator 52. The attenuator 52 includes an elongate body 54 that is substantially tubular in shape. The body 54 may comprise any suitable material and may comprise, for example, aluminum, brass, copper, diamond, gold, iron, lead, Pyrex glass, rubber or steel. The body 54 has a diameter D, a length L, a first end portion 58 and a second end portion 60 opposite to the first end portion 58.

When viewed in cross section, the body 54 has a spiral shape (i.e. the body 54 curves from a central point and continuously increases in radius). The body 54 defines a cavity 56 therein (i.e. the body 12 is substantially hollow) and the cavity 56 also has a spiral shape when viewed in cross section. Additionally, the body 54 defines an elongate open aperture 62, having a width W, that extends along the entire length of the body 54 from the first end portion 58 to the second end portion 60. In this embodiment, the length of the elongate open aperture 62 is substantially equal to the length L of the body 54. However, in other embodiments the length of the elongate open aperture 62 may be any substantial portion of the length of the body 54 and may be equal to or greater than ninety percent of the length of the body 54.

The elongate open aperture 62 is 'open' since it is not covered by a barrier that prevents the flow of fluid (e.g. air) into or out of the cavity 14. Consequently, fluid is able to enter and leave the cavity 14 via the elongate open aperture 62 without obstruction. In this embodiment, the first and second end portions 58, 60 are also open. In other embodiments, the first and second end portions 58, 60 may be covered by a barrier which prevents the passage of fluid there through.

The body 54 is configured to attenuate incident acoustic waves over a resonant frequency band. It should be appreciated that the spiral shaped cavity 56 has a length that extends between the opening of the elongate aperture 62 to the centre of the body 54. The path length of the cavity 56 is substantially equal to a quarter of the wavelength of the acoustic waves that are to be attenuated.

As an acoustic wave is incident upon the attenuator 52, part of the acoustic wave enters the cavity 56 and part of the acoustic wave is reflected. In the time the acoustic wave takes to travel down the cavity 56 and back to the elongate open aperture 62, the acoustic wave outside of the attenuator 52 has shifted half a wavelength, and the two waves interfere destructively causing attenuation of the acoustic wave.

The attenuator 52 may provide a number of advantages. Since the length of the cavity 56 is relatively long for the size of the attenuator 52, the attenuator 52 may advantageously attenuate acoustic waves having a relatively large wavelength/relatively low frequency for its given size. Additionally, attenuation of acoustic waves may occur where the acoustic wave has a frequency that is a harmonic of the fundamental frequency of the attenuator 52.

By way of example, the body 54 may define a Bernoulli type spiral with an external radius of 0.0128 m and decay per 90° of 86% with 3.0 turns. This spiral has a characteristic path length of 0.16 m and a corresponding fundamental frequency of 0.74 kHz. The resonant frequency band gap of this attenuator is 0.68 to 0.9 kHz with 60 dB of attenuation. A higher order harmonic also exists at double the fundamental frequency at 1.72 kHz with similar levels of attenuation.

It should be appreciated that an attenuator according to embodiments of the invention may have a body that defines any meandering or labyrinth cavity that causes attenuation of acoustic waves as described in the above paragraphs with reference to FIGS. 5A and 5B.

Figure 6:
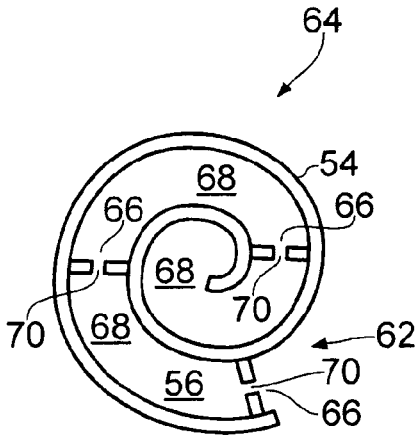
FIG. 6 illustrates a cross sectional plan view of another attenuator according to various embodiments of the present invention.

FIG. 6 illustrates a cross sectional plan view of another attenuator 64 according to various embodiments of the present invention. The attenuator 64 is similar to the attenuator 52 illustrated in FIGS. 5A and 5B and where the features are similar, the same reference numerals are used. The attenuator 64 differs from the attenuator 52 in that the body 54 includes a plurality of walls 66 within the cavity 56. The walls 66 divide the cavity 56 into a plurality of compartments 68 and in this embodiment, the walls 66 extend radially between adjacent portions of the body 54 and define open elongate apertures 70 that extend for at least a substantially length of the body 54. The compartments 68 and open elongate apertures 70 are configured to attenuate acoustic waves within frequency bands in the same way as the attenuator 10 illustrated in FIG. 1.

Figure 7:
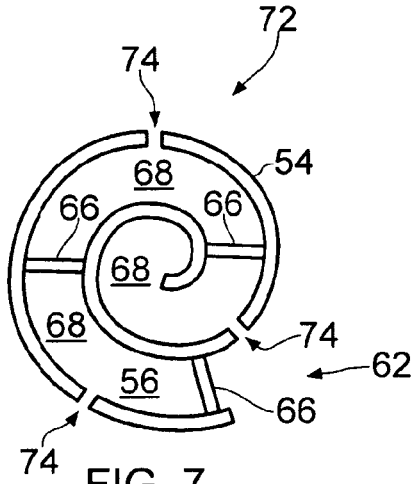
FIG. 7 illustrates a cross sectional plan view of a further attenuator according to various embodiments of the present invention.

FIG. 7 illustrates a cross sectional plan view of another attenuator 72 according to various embodiments of the present invention. The attenuator 72 is similar to the attenuator 64 illustrated in FIG. 6 and where the features are similar, the same reference numerals are used. The attenuator 72 differs from the attenuator 64 in that the plurality of walls 66 do not define open elongate apertures and instead, the body 54 defines a plurality of open elongate apertures 74 (in this example, one elongate open aperture 74 per compartment 68). The compartments 68 and open elongate apertures 74 are configured to attenuate acoustic waves within frequency bands in the same way as the attenuator 10 illustrated in FIG. 1.

Figure 8:
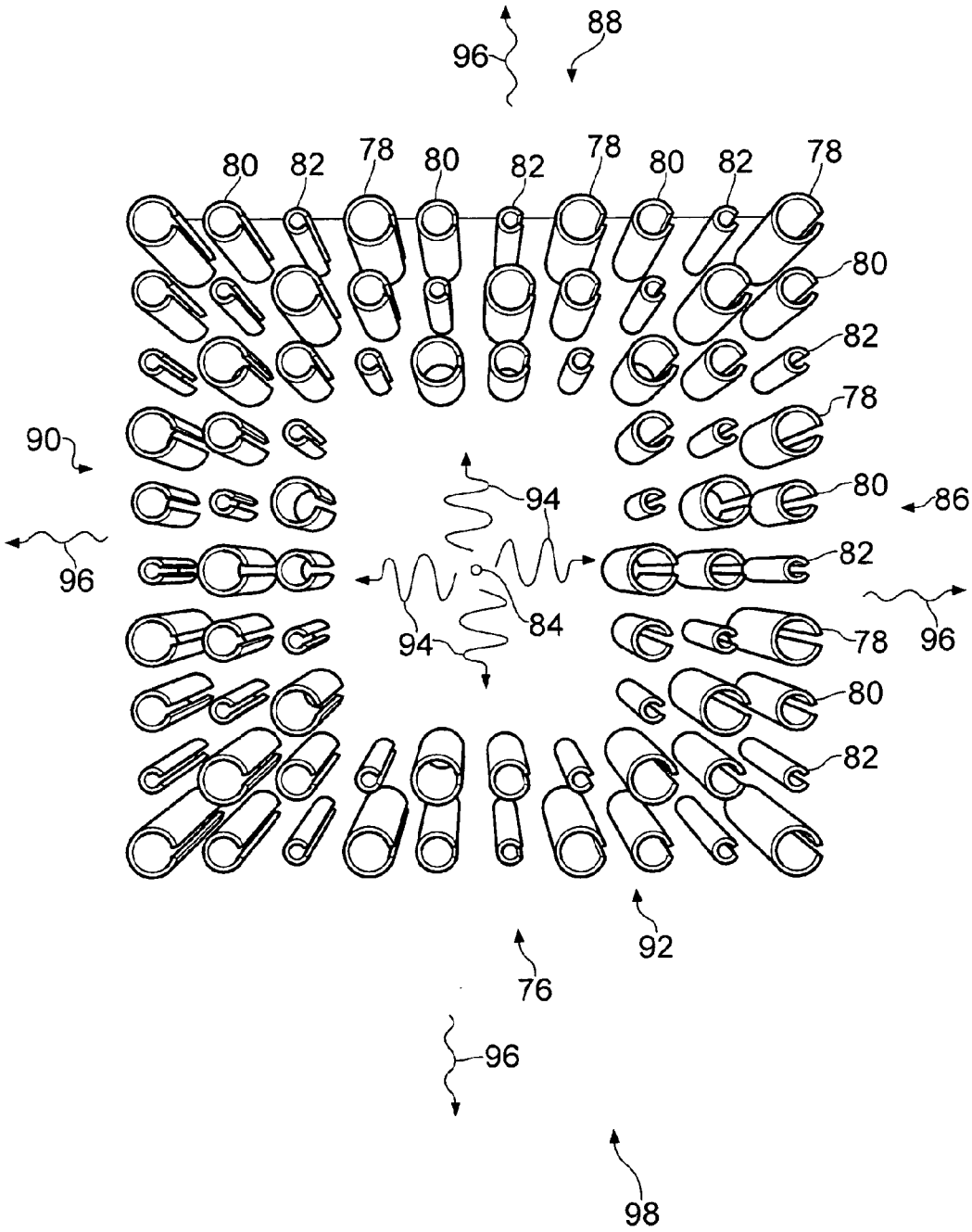
FIG. 8 illustrates a plan view of an arrangement of attenuators according to various embodiments of the present invention.

FIG. 8 illustrates a plan view of an arrangement 76 including a plurality of attenuators according to various embodiments of the present invention. The attenuators illustrated in FIG. 8 are similar to the attenuator 10 illustrated in FIG. 1 and attenuate acoustic waves in a similar manner. In other embodiments, the arrangement 52 may include at least some attenuators which are similar to the attenuators 38, 52, 64, 72 illustrated in FIGS. 4, 5A, 5B, 6 and 7.

The arrangement 76 includes a first subset of attenuators 78 (which are relatively large), a second subset of attenuators 80 (which are medium sized) and a third subset of attenuators 82 (which are relatively small). The attenuators 78 in the first subset are configured to attenuate acoustic waves over a first resonant frequency band (e.g. 1 kHz to 4 kHz). The attenuators 80 in the second subset are configured to attenuate acoustic waves over a second resonant frequency band (e.g. 3 kHz to 7 kHz). The attenuators 82 in the third subset are configured to attenuate acoustic waves over a third resonant frequency band (e.g. 6 kHz to 10 kHz). Consequently, the arrangement 76 is configured to attenuate acoustic waves in the frequency range of 1 to 10 kHz.

The attenuators 78, 80, 82 are spaced apart from one another and the arrangement 76 does not include any members that connect the attenuators 78, 80, 82 to one another. Consequently, the attenuators 78, 80, 82 may be arranged randomly in a square formation around a square space that includes a source 84 of acoustic waves but does not include any attenuators. It has been observed that the distribution of the attenuators 78, 80, 82 does not substantially effect the attenuation provided by the arrangement 76.

The square formation includes a first wall 86, a second wall 88, a third wall 90 and a fourth wall 92. The first, second and third walls 86, 88 and 90 include three layers of attenuators (i.e. they are three attenuators deep). The fourth wall 92 includes two layers of attenuators (i.e. they are two attenuators deep).

The source 84 produces acoustic waves 94 that have relatively high amplitudes (e.g. 70 dB) and have frequencies in the range of 4.2 kHz to 4.9 kHz. The arrangement 76 of attenuators 78, 80, 82 provides an acoustic barrier 98 which attenuates the acoustic waves 94 since the frequencies of the acoustic waves 94 fall within the resonant frequency band of the arrangement 76. Acoustic waves 96 that leave the arrangement 76 have significantly lower amplitudes (e.g. 20 dB) than the acoustic waves 94 produced by the source 84.

Embodiments of the present invention provide an advantage in that an arrangement of attenuators having different dimensions may attenuate acoustic waves over a relatively broad range of frequencies (1 kHz to 10 kHz in the above example). Furthermore, relatively significant attenuation of acoustic waves may be achieved by arranging the attenuators into layers and by increasing the number of the attenuators in a given volume in the arrangement.

Furthermore, since the attenuator in the arrangement may not be connected to one another, the arrangement may be formed into any shape and with any spacing between the attenuators. This may advantageously enable the creation of an acoustic barrier for any frequency to be attenuated.

Figure 9:
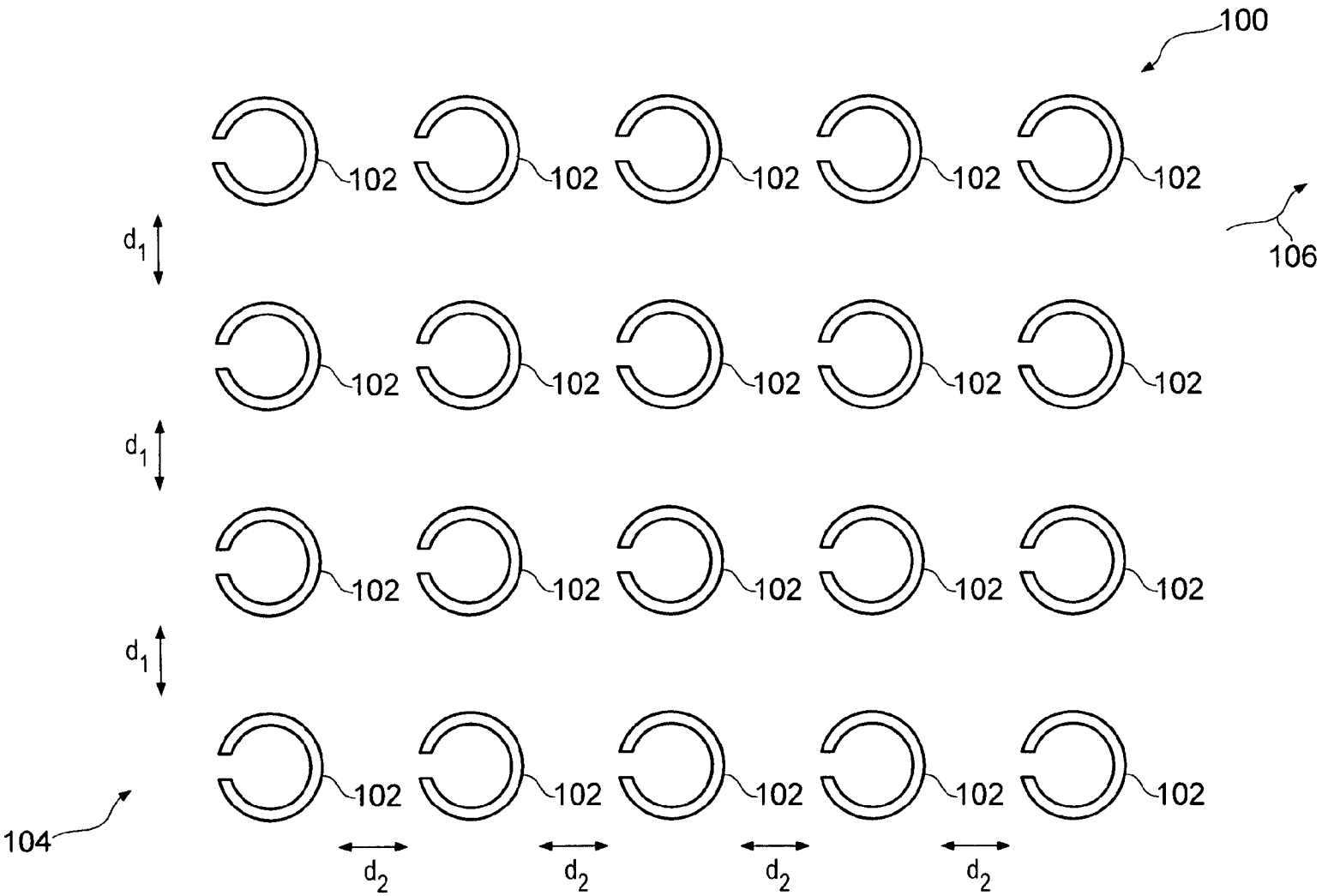
FIG. 9 illustrates a plan view of another arrangement of attenuators according to various embodiments of the present invention.

FIG. 9 illustrates a plan view of another arrangement 100 of attenuators 102 according to various embodiments of the present invention. The attenuators 102 may be any suitable attenuators according to embodiments of the present invention and may be, for example, any of the attenuators 10, 38, 52, 64 and 72 (including any combination of these attenuators). In this example, the attenuators 102 are similar to the attenuator 10 illustrated in FIG. 1.

The attenuators 102 are arranged periodically into four rows and five columns. It should be appreciated that this number of rows and columns is for exemplary purposes and the arrangement 100 may have any number of rows and columns. Furthermore, it should be appreciated that the attenuators 102 may be arranged in any periodic arrangement. Each row of attenuators 102 is spaced apart from adjacent rows by a distance $d_1$ and each column of attenuators 102 is spaced apart from adjacent columns by a distance $d_2$. In this example, the distance $d_1$ is substantially equal to the distance $d_2$. In other embodiments, the distance $d_1$ may be different to the distance $d_2$.

In operation, an acoustic wave 104 is incident upon the arrangement 100. As described in the preceding paragraphs, the attenuators 102 attenuate the acoustic wave 104 in each of their individual resonant frequency bands. Additionally, the collective arrangement of the attenuators also attenuates the acoustic wave 104 in a further resonant frequency band due to the acoustic wave 104 being reflected off of the attenuators 102 and causing destructive interference in accordance with Braggs law. The wavelength at which the acoustic wave 104 is attenuated is given by:

$$n\lambda=2d \sin \theta \qquad \text{Equation 1}$$

Where d is the distance between the rows or columns and θ is the angle of incidence of the acoustic wave relative to the row/column. From equation 1 it should be appreciated that the further resonant frequency band of the arrangement 100 is dependent upon the distances $d_1$ and $d_2$ between the attenuators 102.

Figure 10:
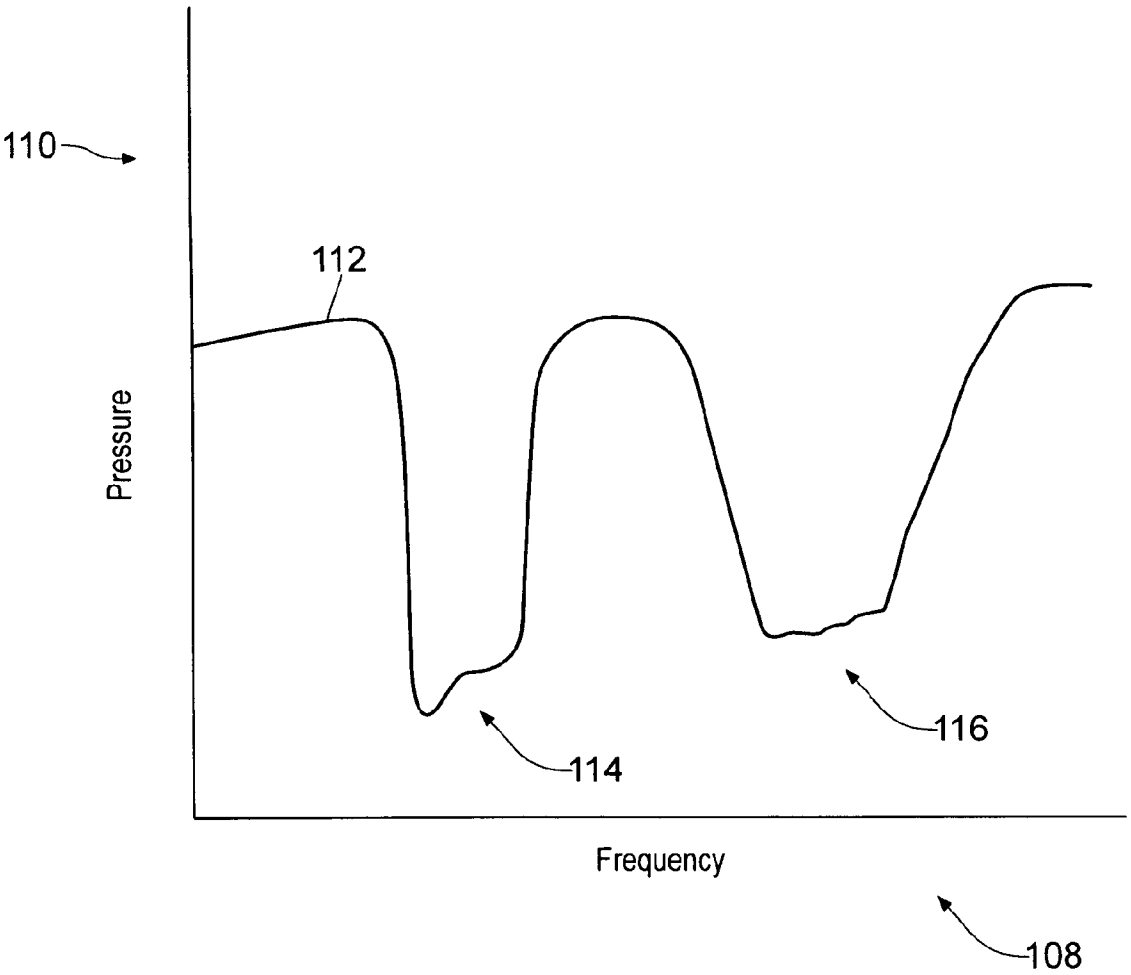
FIG. 10 illustrates a graph of frequency versus pressure for the arrangement of attenuators illustrate in FIG. 9.

FIG. 10 illustrates a graph of frequency versus pressure for an acoustic wave 106 (please see FIG. 9) attenuated by the arrangement 100 of attenuators 102 illustrated in FIG. 9. The graph includes an X axis 108 for frequency, a Y axis 110 for pressure and a solid line 112 representing the attenuated acoustic wave 106.

The line 112 includes a first minima 114 in pressure in a first frequency band and a second minima 116 in pressure in a second frequency band. The second frequency band is at higher frequencies than the first frequency band. The first minima 114 is caused by attenuation by the individual attenuators 102 and the second minima 116 is caused by attenuation by the collective arrangement of attenuators 102 as described above.

The arrangement 100 illustrated in FIG. 9 may provide an advantage in that the attenuation frequency band of the collective arrangement 100 of attenuators 102 may be tuned to desired frequencies by changing the distance between the rows/columns of attenuators 102. For example, if a particularly wide attenuation frequency band is desired, the distance between the rows and columns may be selected so that the first minima 114 and the second minima at least partially overlap one another.

An arrangement of attenuators according to embodiments of the present invention may be formed into one or more acoustic barriers for a variety of different applications.

One such application is to arrange a plurality of attenuators into a fence-like acoustic barrier around a property (e.g. a house or an office) to reduce noise received at the property. Embodiments of the present invention provide several advantages in this application. For example, the acoustic barrier may allow drainage of surface water and flow of fresh air since the attenuators in the acoustic barrier are spaced apart from one another and may not be connected to one another. Additionally, the acoustic barrier may be made from opaque or transparent materials depending on the location of the property (e.g. urban or rural). For example, if the property is located in an urban area, the acoustic barrier may be made from opaque materials in order to increase privacy. If the property is located in a rural area, the acoustic barrier may be made from transparent materials in order to improve the view from the property.

Another application is to install a plurality of attenuators according to embodiments of the present invention into the wall cavity and/or into the roofing space of a property to form an acoustic barrier which reduces noise entering the property.

A further application is to install a plurality of attenuators according to embodiments of the present invention alongside a road, train track or airport runway to reduce the noise from the road, train track or runway. As mentioned above, such an acoustic barrier provides an advantage in that it allows drainage of surface water and flow of fresh air and may be formed from opaque or transparent materials depending on the location.

Another application is to form a plurality of attenuators according to embodiments of the invention into an acoustic barrier blind for a window which reduces noise received from outside the window and also allows the window to remain open and allow the passage of fresh air there through.

The above described acoustic barriers provide several advantages for a person due to the reduction of noise. These advantages include lessened sleep disturbance, improved ability to enjoy outdoor life, reduced speech interference, stress reduction, reduced risk of hearing impairment and reduction in blood pressure (improved cardiovascular health).

Although embodiments of the present invention have been described in the preceding paragraphs with reference to various examples, it should be appreciated that modifications to the examples given can be made without departing from the scope of the invention as claimed. For example, the body of an attenuator may have any suitable shape and may have, for example, a square or triangular cross section. Furthermore, the cross sectional dimensions (e.g. diameter) of the body may vary along the length of the body. The elongate open aperture may have any suitable shape, length, and may have a width that varies along the length of the body.

In the above described embodiments, the attenuators are configured for attenuating acoustic waves. It should be appreciated that in other embodiments of the present invention, the attenuators may be configured for attenuating other forms of wave. For example, the attenuators may be configured for attenuating waves in the sea and a plurality of such attenuators may be provided for forming a sea wave defense barrier. Such a barrier may be formed to defend against Tsunamis. The attenuators may be configured for attenuating seismic waves in the earth and a plurality of such attenuators may be provided for attenuating earthquakes.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An arrangement comprising:

a plurality of attenuators for attenuating acoustic waves, each attenuator comprising a first body defining a first cavity therein and a first elongate open aperture extending across at least a substantial portion of the first body, the first body being configured to attenuate the acoustic waves over a resonant frequency band, and wherein at least some of the plurality of attenuators are arranged periodically into a plurality of rows, wherein a distance between adjacent ones of the plurality of rows is selected such that the plurality of rows of attenuators are configured to attenuate the acoustic waves over a further selected resonant frequency band.

2. The arrangement of claim 1 wherein the first body is substantially elongate in shape and the first elongate open aperture extends along a length of the first body.

3. The arrangement of claim 2 wherein the first elongate open aperture extends along at least a substantial portion of the length of the first body.

4. The arrangement of claim 1 wherein a magnitude of attenuation provided by at least one attenuator of the plurality of attenuators is substantially unaffected by an orientation of the at least one attenuator relative to a source of the acoustic waves.

5. The arrangement of claim 1 wherein one or more attenuators of the plurality of attenuators further comprise a second body positioned within the first cavity of the first body, the second body defining a second cavity therein and a second elongate open aperture extending across at least a substantial portion of the second body, the second body being configured to attenuate the acoustic waves over another resonant frequency band, different from the resonant frequency band.

6. The arrangement of claim 5 wherein the first body and the second body are not connected to one another.

7. The arrangement of claim 5 wherein the second body is replaceable with a third body, the third body defining a third cavity therein and a third elongate open aperture extending across at least a substantial portion of the third body, the third body being configured to attenuate the acoustic waves over an additional resonant frequency band, different from the resonant frequency band and the another resonant frequency band.

8. The arrangement of claim 1 wherein the first body defines a spiral shape in cross section.

9. The arrangement of claim 8 wherein one or more attenuators of the plurality of attenuators further comprise a plurality of walls within the first cavity that define a plurality of compartments, wherein the first body comprises a plurality of open elongate apertures for at least some of the plurality of compartments.

10. The arrangement of claim 8 wherein one or more attenuators of the plurality of attenuators further comprise a plurality of walls within the first cavity that define a plurality of compartments, wherein at least some of the plurality of walls define an open elongate aperture.

11. The arrangement of claim 1 wherein the plurality of attenuators are not connected to one another.

12. The arrangement of claim 1 wherein a first subset of the plurality of attenuators is configured to attenuate the acoustic waves over a first resonant frequency band and a second subset of the plurality of attenuators is configured to attenuate the acoustic waves over a second resonant frequency band, different from the first resonant frequency band.

13. The arrangement of claim 1 wherein the plurality of attenuators includes a plurality of subsets of attenuators, each subset of attenuators being configured to attenuate the acoustic waves over a respective resonant frequency band, different from other respective resonant frequency bands of the other subsets of attenuators.

14. An acoustic barrier for attenuating acoustic waves, the acoustic barrier comprising an arrangement comprising:

a plurality of attenuators for attenuating the acoustic waves, each attenuator comprising a first body defining a first cavity therein and a first elongate open aperture extending across at least a substantial portion of the first body, the first body being configured to attenuate the acoustic waves over a resonant frequency band, and wherein at least some of the plurality of attenuators are arranged periodically into a plurality of rows, wherein a distance between adjacent ones of the plurality of rows is selected such that the plurality of rows of attenuators are configured to attenuate the acoustic waves over a further selected resonant frequency band.

15. The acoustic barrier of claim 14 wherein the plurality of attenuators of the arrangement are spaced apart from one another for enabling passage of light and/or fresh air therethrough.

16. A method for constructing an acoustic barrier, the method comprising:

providing an arrangement comprising a plurality of attenuators for attenuating acoustic waves, the attenuators comprising a first body defining a first cavity therein and a first elongate open aperture extending across at least a substantial portion of the first body, the first body being configured to attenuate the acoustic waves over a resonant frequency band, and wherein at least some of the plurality of attenuators are arranged periodically into a plurality of rows, wherein a distance between adjacent ones of the plurality of rows is selected so that the plurality of rows of attenuators are configured to attenuate the acoustic waves over a further selected resonant frequency band; and arranging the plurality of attenuators in the arrangement to form the acoustic barrier.

17. The method of claim 16 further comprising arranging the plurality of attenuators so that the plurality of attenuators are spaced apart from one another for enabling passage of light and/or fresh air therethrough.

18. The arrangement of claim 1 wherein the first body defines a single elongate open aperture.

19. The arrangement of claim 1 wherein the resonant frequency band is independent of a material of the first body.

* * * * *